US011585575B2

(12) United States Patent
Zou et al.

(10) Patent No.: US 11,585,575 B2
(45) Date of Patent: Feb. 21, 2023

(54) DUAL-CIRCUIT HEATING, VENTILATION, AIR CONDITIONING, AND REFRIGERATION SYSTEMS AND ASSOCIATED METHODS

(71) Applicant: Rheem Manufacturing Company, Atlanta, GA (US)

(72) Inventors: Yang Zou, Dallas, TX (US); Sivakumar Gopalnarayanan, Dallas, TX (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 302 days.

(21) Appl. No.: 16/923,667

(22) Filed: Jul. 8, 2020

(65) Prior Publication Data

US 2022/0011024 A1 Jan. 13, 2022

(51) Int. Cl.

| | |
|---|---|
| ***F25B 9/10*** | (2006.01) |
| ***F25B 39/00*** | (2006.01) |
| ***F25B 9/00*** | (2006.01) |

(52) U.S. Cl.

CPC ..... *F25B 9/10* (2013.01); *F25B 9/006* (2013.01); *F25B 39/00* (2013.01); *F25B 2400/06* (2013.01)

(58) Field of Classification Search

CPC .. F25B 9/10; F25B 9/006; F25B 39/00; F25B 2400/06; F25B 9/008

See application file for complete search history.

(56) References Cited

U.S. PATENT DOCUMENTS

| | | | |
|---|---|---|---|
| 6,616,428 | B2 | 9/2003 | Ebara et al. |
| 9,188,372 | B2 | 11/2015 | Thomas et al. |
| 9,448,013 | B2 | 9/2016 | Ito et al. |
| 9,651,317 | B2 | 5/2017 | Jindou et al. |
| 9,677,818 | B2 | 6/2017 | Numata et al. |
| 10,035,937 | B2 | 7/2018 | Yana Motta et al. |
| 10,180,257 | B2 | 1/2019 | Cur et al. |
| 10,287,469 | B2 | 5/2019 | Kontomaris et al. |
| 10,539,358 | B2 | 1/2020 | Suzuki et al. |
| 2010/0193155 | A1 | 8/2010 | Nakatani et al. |
| 2017/0131034 | A1 | 5/2017 | Ribarov et al. |

(Continued)

FOREIGN PATENT DOCUMENTS

| | | |
|---|---|---|
| EP | 2306122 B1 | 7/2017 |
| JP | 5665937 | 2/2015 |

(Continued)

*Primary Examiner* — Ana M Vazquez

(74) *Attorney, Agent, or Firm* — Eversheds Sutherland (US) LLP

(57) ABSTRACT

Systems and methods for improved heating, ventilation, air conditioning, and refrigeration systems incorporating a plurality of refrigerant circuits. The system can include a compressor having a first compression chamber, a second compression chamber, and a motor. The system can further include a heat exchanger having a first set of microchannel coils and a second set of microchannel coils. The system can have a first circuit fluidly coupled between the first compression chamber and the first set of microchannel coils and a second circuit fluidly coupled between the second compression chamber and the second set of microchannel coils. Further, the first circuit comprises a first refrigerant and the second circuit comprises a second refrigerant.

18 Claims, 6 Drawing Sheets

(56) References Cited

U.S. PATENT DOCUMENTS

| | | | | |
|---|---|---|---|---|
| 2019/0368817 | A1 | 12/2019 | Huang et al. | |
| 2020/0149749 | A1 | 5/2020 | Tallakson et al. | |
| 2021/0048251 | A1 * | 2/2021 | Sathyamurthi ..... | F28D 15/043 |

FOREIGN PATENT DOCUMENTS

| | | |
|---|---|---|
| KR | 101681585 | 12/2016 |
| WO | 2014/156190 | 2/2017 |
| WO | 2017/103988 | 6/2017 |
| WO | WO-2017103988 A1 * | 6/2017 |

* cited by examiner

DUAL-CIRCUIT HEATING, VENTILATION, AIR CONDITIONING, AND REFRIGERATION SYSTEMS AND ASSOCIATED METHODS

FIELD OF THE TECHNOLOGY

The presently disclosed subject matter generally relates to improved heating, ventilation, air conditioning, and refrigeration (HVAC&R) systems, and more specifically, to HVAC&R systems incorporating a plurality of refrigerant circuits.

BACKGROUND

HVAC&R systems are utilized in residential, commercial, and industrial environments to control environmental properties, such as temperature and humidity, for occupants of the respective environments. The HVAC&R systems may control the environmental properties through control of an airflow delivered to the environment. In some cases, HVAC&R systems include a heat exchanger that is configured to exchange thermal energy, such as heat, between a working fluid flowing through conduits or coils of the heat exchanger and an airflow flowing across the conduits or coils. Heat exchangers are devices built for transferring heat from one fluid to another. Heat is typically transferred without mixing of the fluids, which can be separated by a solid wall or other divider. Specifically, in prior art HVAC&R systems (e.g., air conditioner, a freezer, a water heater and the like) components such as a compressor, a condenser (heat exchanger), an expansion valve, and an evaporator (heat exchanger) can be connected by piping so as to constitute a refrigerant circuit through which a refrigerant is circulated. By using heating (radiation) and cooling (heat absorption) of the refrigerant, they system can perform cooling and heating operations operation.

The choice of a refrigerant or heat-transfer fluid (which may be a pure compound or a mixture of compounds) is dictated, on the one hand, by the thermodynamic properties of the fluid, and on the other hand, by additional constraints. Thus, one particularly important criterion is that of the impact of the fluid under consideration on the environment. A concern surrounding many existing refrigerants is the tendency of many such products to cause global warming. This characteristic is commonly measured as global warming potential (GWP). The GWP of a compound is a measure of the potential contribution to the greenhouse effect of the chemical against a known reference molecule, namely, CO2 which has a GWP=1.

Conventionally, "HFC refrigerants" such R-410A have been used as a refrigerant for a refrigeration cycle performed by an air-conditioning apparatus and present advantages, such as being non-flammable. However, such refrigerants typical have high global warming potential (hereinafter referred to as "GWP"). Recently, low GWP refrigerants have been developed as alternatives to R-410A, however such refrigerants are typically flammable resulting in higher safety requirements, such as the limits to the amount of charge per circuit without the need for costly safety sensors. As will be appreciated, systems incorporating low GWP refrigerants are typically more costly to manufacture and maintain.

Accordingly, there is a need for improved HVAC&R systems, and more specifically, to HVAC&R systems configured to safely incorporating larger amounts of low GWP refrigerant.

SUMMARY

Examples of the present disclosure include improved HVAC&R devices and systems. The system can include a dual-circuit compressor and a dual-circuit heat exchanger. The dual-circuit compressor can include a first compression chamber, a second compression chamber, and a motor. The first compression chamber can be fluidly separate from the second compression chamber. Further, the heat exchanger can include a first set of microchannel coils and a second set of microchannel coils. The system additionally includes a first circuit fluidly coupled between the first compression chamber and the first set of microchannel coils and a second circuit fluidly coupled between the second compression chamber and the second set of microchannel coils. Further, the first circuit and the second circuit are fluidly separate from one another.

A further example of the present disclosure can provide a system wherein the first circuit comprises a first refrigerant and the second circuit comprise a second refrigerant. Further, the first refrigerant and the second refrigerant can comprise the same type of refrigerant. Additionally, the first refrigerant and the second refrigerant can comprise other refrigerants that have a lower GWP, such as R-454B for example. Further, the first refrigerant and the second refrigerant can comprise R-32.

An additional example of the present disclosure can provide a system wherein the first circuit comprises a first refrigerant and the second circuit comprise a second refrigerant that is different from the first type of refrigerant. The first refrigerant can comprise one of R-32 and R-454B and the second refrigerant can comprise one of R-290, R-744 ($CO_2$), and R-454B.

Another example of the present disclosure can provide a system that can further include a condenser and an evaporator. The condenser can comprise a condenser heat exchanger having a third set of microchannel coils and a fourth set of microchannel coils. Additionally, the first circuit can be fluidly coupled with the third set of microchannel coils, and the second circuit can be fluidly coupled with the fourth set of microchannel coils.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and which are incorporated into and constitute a portion of this disclosure, illustrate various implementations and aspects of the disclosed technology and, together with the description, serve to explain the principles of the disclosed technology. In the drawings.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

Figure 1:
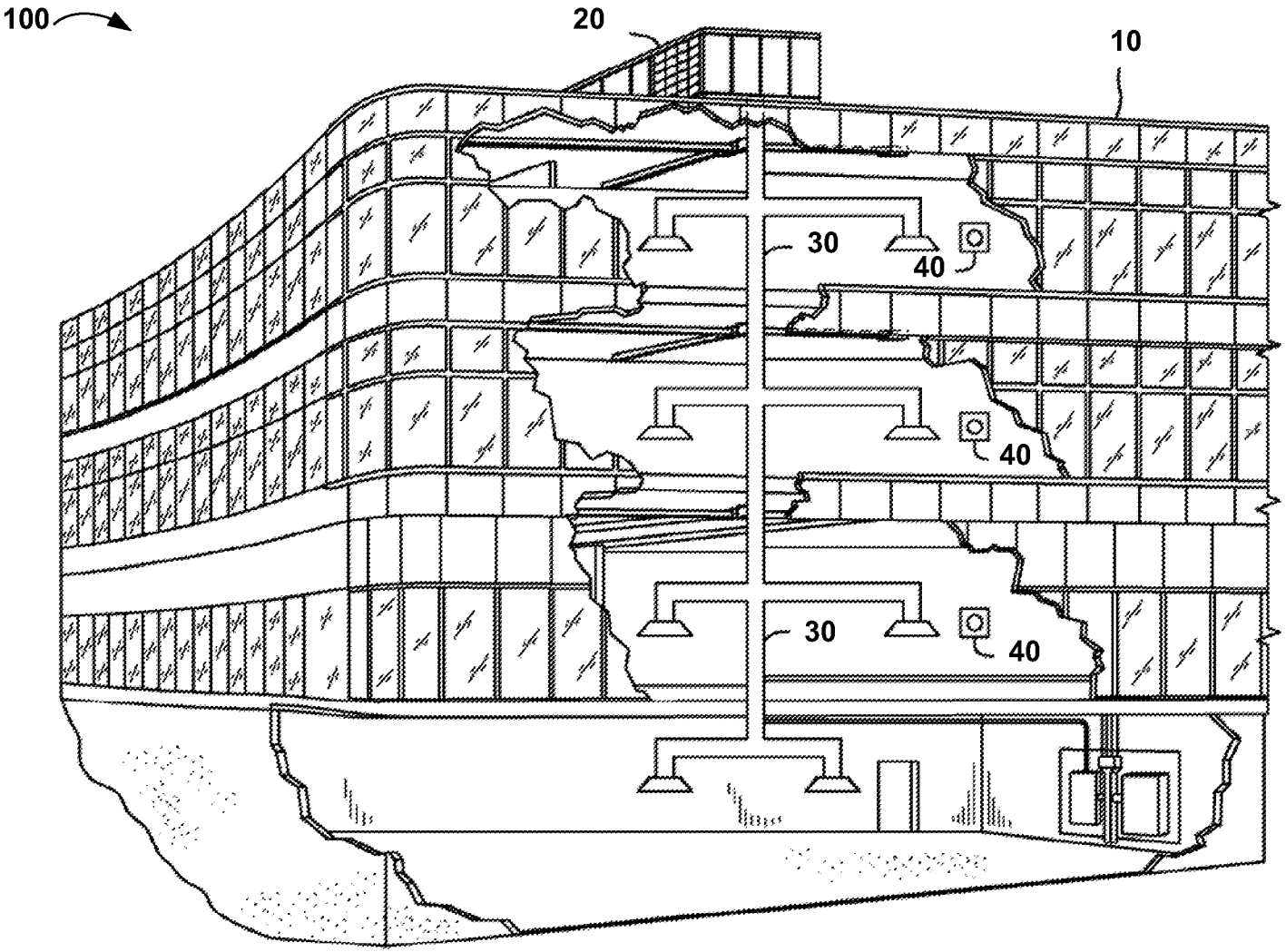
FIG. 1 depicts a dual-circuit HVAC&R system, in accordance with some examples of the present disclosure.

Disclosed are improved heat exchanger devices and systems incorporating configurations and mechanisms to improve air distribution along the heat exchanger tubes. A dual-circuit HVAC&R system can include an interlaced heat exchanger and a dual-circuit compressor providing for two independent refrigerant paths, or circuits. Two refrigerant circuits each having the same refrigerant. Specifically, dual-circuit HVAC&R system can include two refrigerant circuits each having R-454B, R-32, or other similar refrigerants. As will be appreciated, in such an example, the system may include more refrigerant, thus allowing for more efficient operation, while reducing the charge of each circuit.

Alternatively, the dual-circuit HVAC&R system can include two refrigerant circuits each having a different refrigerant. Specifically, the dual-circuit HVAC&R system can include two refrigerant circuits with one circuit having R-410A, R-32, R-454B, R-1234yf, or other similar refrigerants and the other circuit having R-290, R-744 ($CO_2$), R-1234yf, or other similar refrigerants. As will be appreciated, by minimizing the refrigerant charge in each refrigerant circuit, the systems will be posited to satisfy existing and future safety requirements set forth by standards bodies and/or regulatory bodies (e.g., GWP rating), which can thereby reduce environmental impact. For example, such a dual-circuit HVAC&R system can adhere to GWP regulations and restrictions by incorporating a low GWP refrigerant while also adhering to the regulations and restrictions directed to the low GWP refrigerant (e.g., regulations or restrictions associated with an increased flammability or toxicity or other possible undesirable properties of low GWP refrigerants).

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Reference will now be made in detail to example embodiments of the disclosed technology, examples of which are illustrated in the accompanying drawings and disclosed herein.

FIG. 1 depicts an example dual-circuit HVAC&R system 100 for building environmental management that may employ one or more HVAC&R units 20. Building 10 can be air conditioned by dual-circuit HVAC&R system 100 that can include an HVAC&R unit 20. As will be appreciated, building 10 can be a commercial structure or a residential structure. As shown, HVAC unit 20 can be disposed on the roof of the building 10. However, as will be appreciated, HVAC&R unit 20 can be located in other equipment rooms or areas adjacent building 10. HVAC&R unit 20 can be a single packaged unit containing other equipment, such as a blower, integrated air handler, and/or auxiliary heating unit such as HVAC&R unit depicted in FIG. 2. In other embodiments, the HVAC&R unit 20 may be part of a split HVAC&R system, such as the system shown in FIG. 3, which includes an outdoor HVAC&R unit 310 and an indoor HVAC&R unit 320.

The HVAC&R unit 20 can be an air cooled device that implements a refrigeration cycle to provide conditioned air to the building 10. Further, the HVAC&R unit 20 can include one or more heat exchangers across which an air can be passed to be conditioned before being supplied to the building 10. As depicted, the HVAC&R unit 20 can be a rooftop unit (RTU) that conditions a supply air stream, such as environmental air and/or a return air flow from the building 10. After the HVAC&R unit 20 conditions the air, the air can be supplied to the building 10 via ductwork 30 extending throughout the building 10. For example, the ductwork 30 can extend to various individual floors or other sections of the building 10. The HVAC&R unit 20 can include a heat pump that provides both heating and cooling to the building with one refrigeration circuit configured to operate in different modes. Alternatively or additionally, the HVAC&R unit 20 can include one or more refrigeration circuits for cooling an air stream and a furnace for heating the air stream.

A control device 40, such as, for example, a thermostat, can be used to designate the temperature of the conditioned air. The control device 40 can also be used to control the flow of air through the ductwork 30. For example, the control device 40 can be used to regulate operation of one or more components of the HVAC unit 20 or other components, such as dampers and fans, within the building 10 that may control flow of air through and/or from the ductwork 30. Further, other devices can be included in the system, such as pressure and/or temperature transducers or switches that sense the temperatures and pressures of the supply air, return air, and so forth. Moreover, the control device 40 can include computer systems that are integrated with or separate from other building control or monitoring systems, and even systems that are remote from the building 10.

Figure 2:
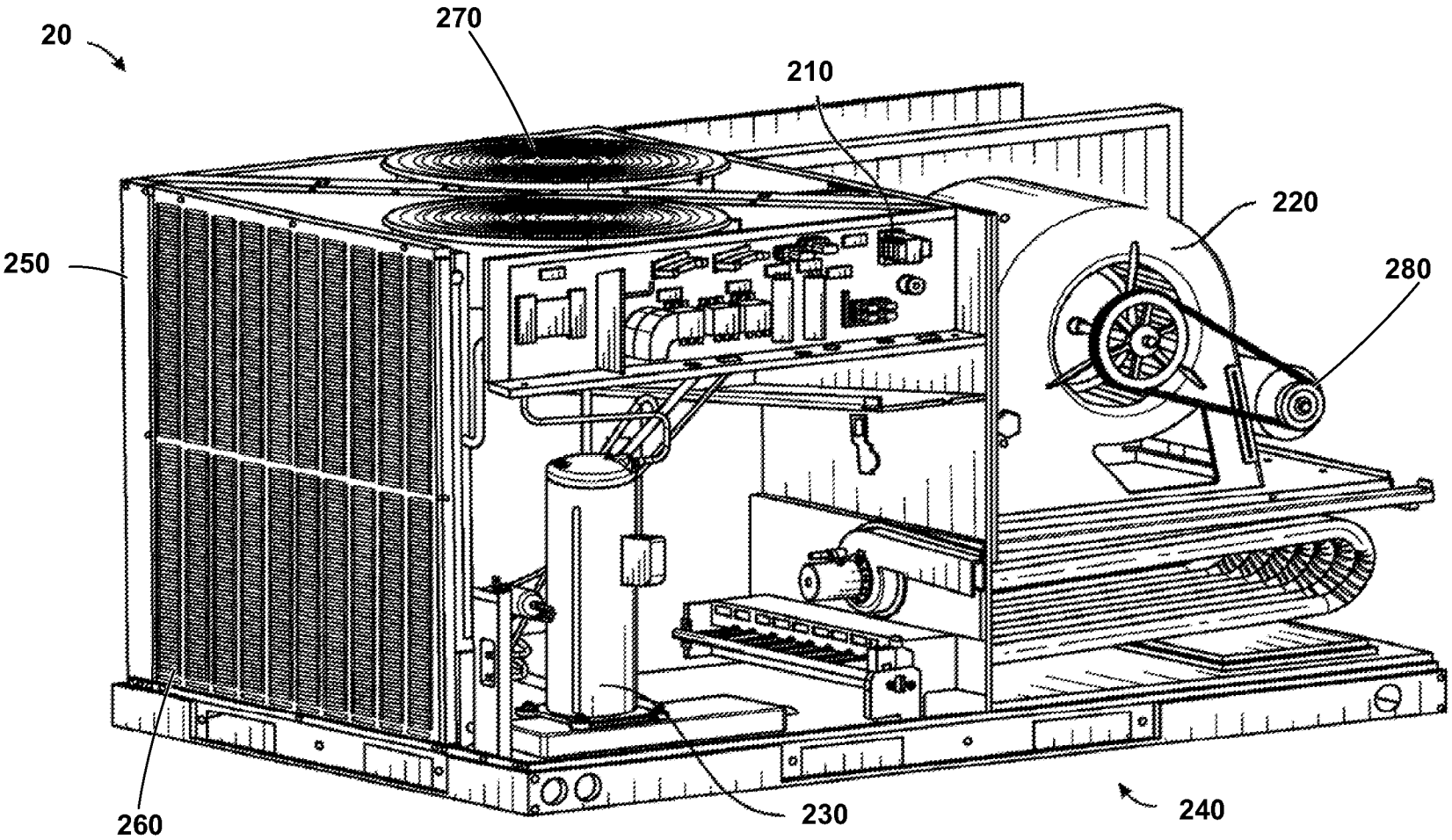
FIG. 2 depicts an HVAC&R unit, in accordance with some examples of the present disclosure.

FIG. 2 depicts an example HVAC&R unit 20 with outer panels removed so that the interior components of the HVAC&R unit 20 can been shown. As depicted, the HVAC&R unit 20 is a single package unit that can include one or more independent refrigeration circuits and components that are tested, charged, wired, piped, and ready for installation. The HVAC&R unit 20 can provide a variety of heating and/or cooling functions, such as cooling only, heating only, cooling with electric heat, cooling with dehumidification, cooling with gas heat, or cooling with a heat pump. As described above, the HVAC&R unit 20 can directly cool and/or heat an air stream provided to the building 10 to condition a space in the building 10.

Certain of the primary components of the HVAC&R unit 20 are identified in FIG. 2 including the control panel 210, the blower unit 220, the compressor 230, the heating system 240, and the cabinet 250. The control panel 210 can comprise a controller that receives inputs from a thermostat and controls the operation of the HVAC&R unit 20. The blower unit 220 is used to provide cooled or heated air to an enclosed space. The compressor 230 is part of the cooling system of the HVAC unit and compresses a refrigerant for cooling air that is circulated by the blower unit 220.

Cabinet 250 can enclose the HVAC&R unit 20 and provide structural support and protection to the internal components from environmental and other contaminants. Cabinet 250 can be constructed of galvanized steel and insulated with aluminum foil faced insulation. Cabinet 250 can include one or more rails (not pictured) which can be joined to the bottom perimeter of the cabinet 250 in order to provide a foundation for the HVAC&R unit 20. Optionally, the rails can provide access for a forklift and/or overhead rigging to facilitate installation and/or removal of the HVAC&R unit 20.

The heating system 240 can include one or more heat exchanger 260 in fluid communication with one or more refrigeration circuits. Tubes within the one or more heat exchanger 260 can circulate refrigerant, such as R-410A, through the one or more heat exchanger 260. The tubes can be of various types, such as multichannel tubes, conventional copper or aluminum tubing, and so forth. The one or more heat exchanger 260 can implement a thermal cycle in which the refrigerant undergoes phase changes and/or temperature changes as it flows through the one or more heat exchanger 260 to produce heated and/or cooled air. For example, one of the one or more heat exchanger 260 can function as a condenser where heat is released from the refrigerant to ambient air, and another of the one or more heat exchanger 260 can function as an evaporator where the refrigerant absorbs heat to cool an air stream. In other embodiments, the HVAC&R unit 20 may operate in a heat pump mode where the roles of the one or more heat exchanger 260 may be reversed. The HVAC&R unit 20 may include a furnace for heating the air stream that is supplied to the building 10.

Figure 5:
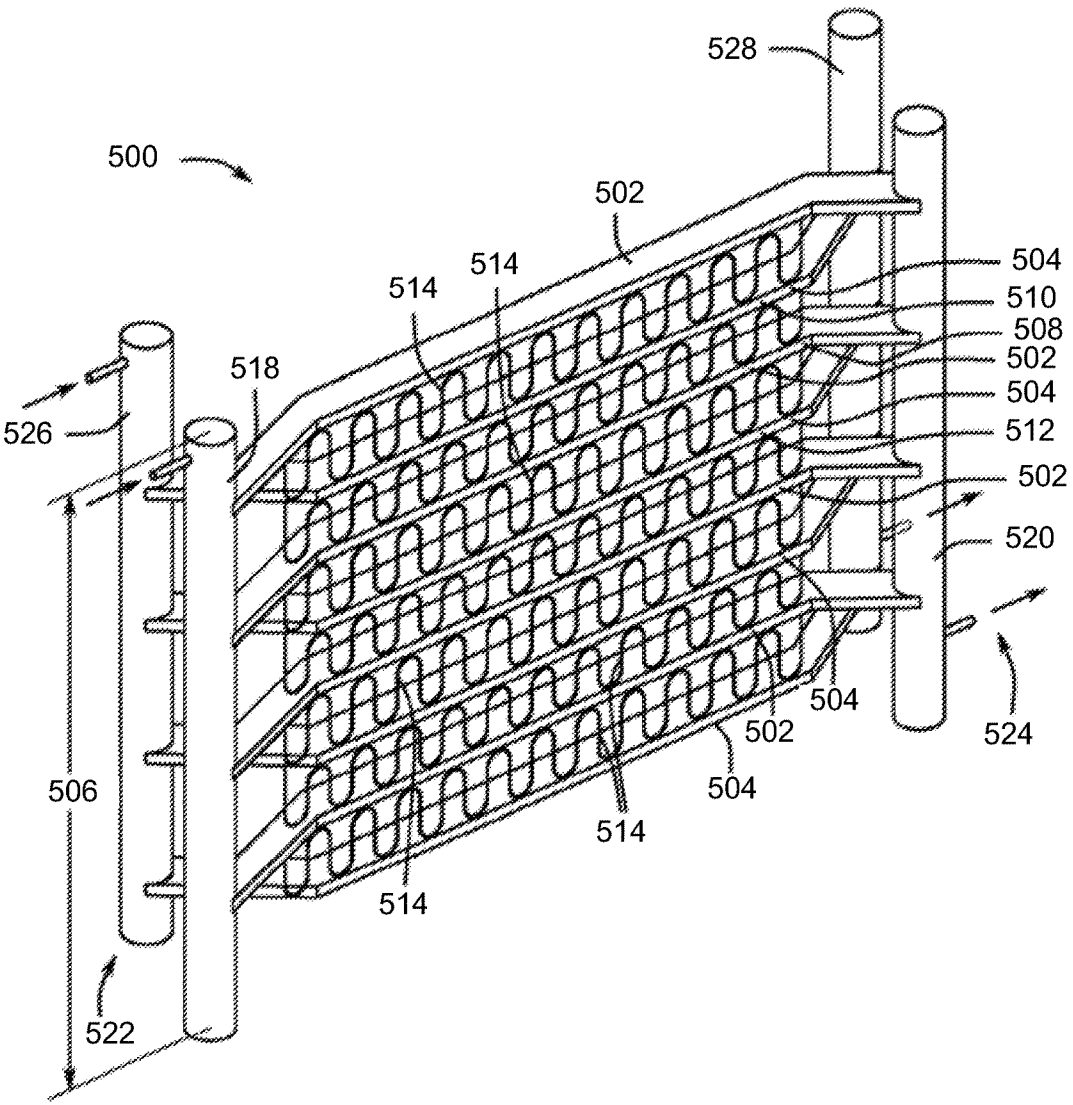
FIG. 5 depicts an interlaced heat exchanger for use in systems from FIGS. 1-4, in accordance with some examples of the present disclosure.

The one or more heat exchanger 260 can be an interlaced heat exchanger, such as heat exchanger 500 depicted in FIG. 5 and described further herein. Such interlaced heat exchangers can be configured to share a heat exchange surface area between first coils that are fluidly coupled to a first working fluid circuit and second coils that are fluidly coupled to a second working fluid circuit. As will be appreciated, such interlaced heat exchangers allow for a multiple circuit system having a plurality of refrigerant circuits flowing independently through the system. As previously discussed, such a design allows for both improvements in heating and cooling performance by allowing for choosing optimal refrigerants. For example, R-744 ($CO_2$), which, in a basic refrigeration cycle, generally performs better in heating (in a heat pump mode) than in cooling (in an air conditioning mode), can be utilized in areas where the heating loads may be higher than the cooling loads. Additionally, such dual-circuit designs allow for the reduction of GWP through the use of smaller amounts of low GWP refrigerants in each respective circuit, which allows for better management of the potential hazards (e.g., flammability, leaks) associated with such refrigerants.

The dual-circuit HVAC&R system 100 can include two refrigerant circuits. The refrigerant circuits can each have the same refrigerant. Specifically, dual-circuit HVAC&R system 100 can include two refrigerant circuits each having R-454B, R-32, or other similar refrigerants. As will be appreciated, in such an example, the system 100 may include more refrigerant, thus allowing for more efficient operation, while reducing the charge of each circuit. Alternatively, the dual-circuit HVAC&R system 100 can include two refrigerant circuits each having a different refrigerant. For example, dual-circuit HVAC&R system 100 can include two refrigerant circuits with one circuit having R-410A, R-32, R-454B, R-1234yf, or other similar refrigerants and the other circuit having R-290, R-744 ($CO_2$), R-1234yf, or other similar refrigerants. As will be appreciated, by minimizing the refrigerant charge in each refrigerant circuit, the systems will be posited to satisfy existing and future safety requirements set forth my standards bodies and/or regulatory bodies (e.g., GWP rating), which can thereby reduce environmental impact.

While the present discussion focuses on an interlaced heat exchanger in a dual circuit system (e.g., dual-circuit HVAC&R system 100), or a system having a first working fluid circuit and a second working fluid circuit, the present disclosure can also be utilized for systems that include three circuits, four circuits, five circuits, six circuits, seven circuits, eight circuits, nine circuits, ten circuits, or more than ten circuits. And in furtherance of the disclosure herein, each refrigerant circuit can be fluidly separate from the other refrigerant circuits (e.g., fluidly separated conduits, fluidly separated compressor chambers).

As further depicted by FIG. 2, fans 270 can be configured to draw air from the environment through the one or more heat exchanger 260. Air may be heated and/or cooled as the air flows through the one or more heat exchanger 260 before being released back to the environment surrounding the HVAC&R unit 20. Further, blower unit 220, powered by a motor 280, can draw air through the one or more heat exchanger 260 to heat or cool the air. The heated or cooled air may be directed to the building 10 by the ductwork 14, which may be connected to the HVAC&R unit 20. Before flowing through the one or more heat exchanger 260, the conditioned air can flow through one or more filters that can remove particulates and contaminants from the air. The filters can be disposed on the air intake side of the one or more heat exchanger 260, which can help prevent contaminants from contacting the one or more heat exchanger 260.

Additionally, the HVAC&R unit 20 can include other equipment for implementing the thermal cycle. Compressor 230 can increase the pressure and temperature of the refrigerant before the refrigerant enters the one or more heat exchanger 260. The compressor 230 can be or include any suitable type of compressor, such as scroll compressors, rotary compressors, screw compressors, or reciprocating compressors. The compressor 230 can be a dual-circuit compressor, such as dual-circuit compress 600 depicted in FIG. 6 and described further herein. As will be appreciated, such a system having a single compressor with multiple compression chamber can reduce the system's required physical footprint and can reduce manufacturing costs and/or maintenance cost (e.g., by reducing the number of motors required by the system).

Further, the HVAC&R unit 20 can include any number of the compressors 230 can be provided to achieve various stages of heating and/or cooling. For example, the compressor 230 can include a pair of hermetic direct drive compressors arranged in a dual-stage configuration. As may be appreciated, additional equipment and devices can be included in the HVAC&R unit 20, such as a solid-core filter drier, a drain pan, a disconnect switch, an economizer, pressure switches, phase monitors, and humidity sensors, among other things.

Figure 3:
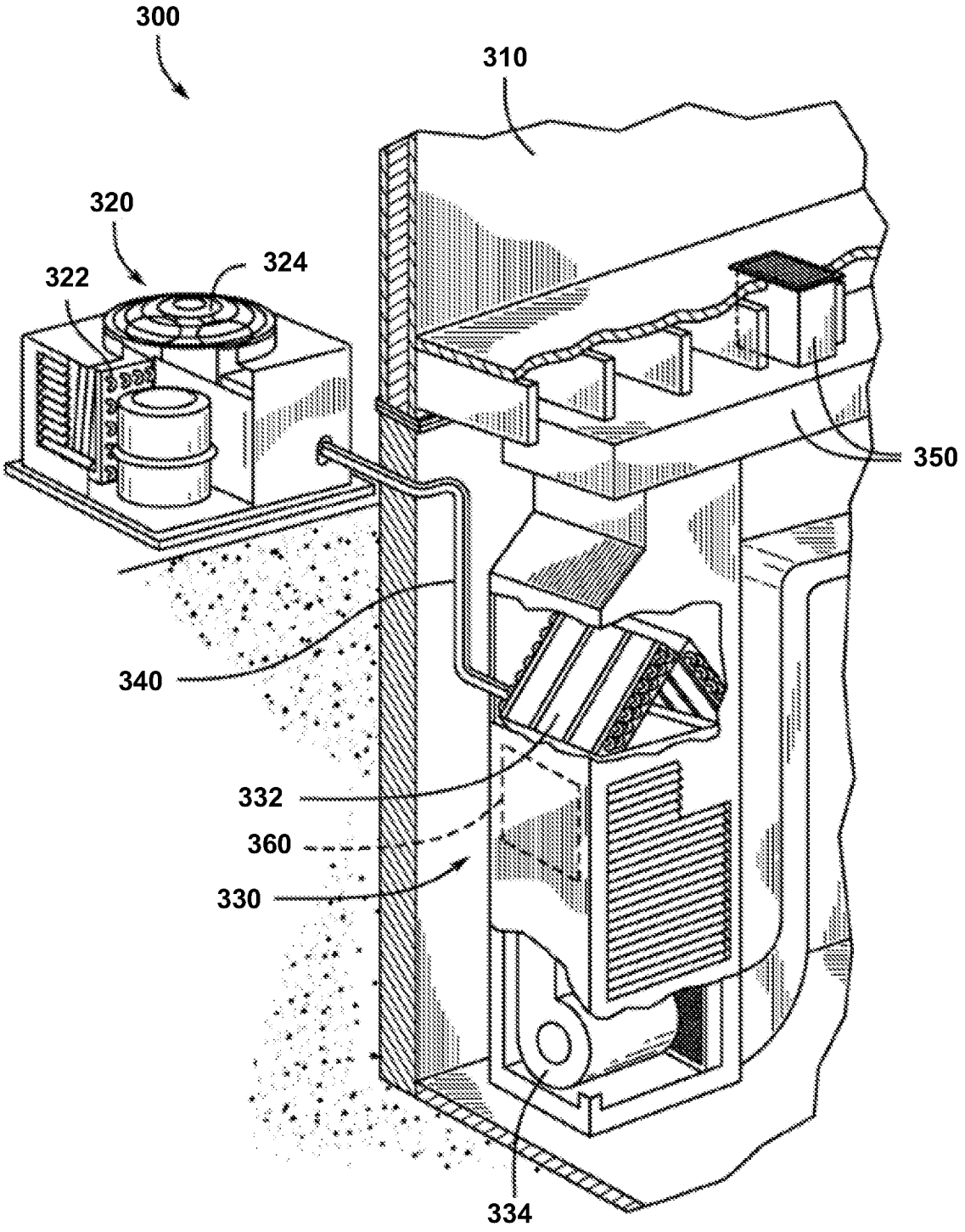
FIG. 3 depicts a residential heating and cooling system, in accordance with some examples of the present disclosure.

FIG. 3 depicts a residential heating and cooling system 300. Residential heating and cooling system 300 can provide heated and cooled air to a residential structure, as well as provide outside air for ventilation. As depicted, residential heating and cooling system 300 can be a split HVAC&R system. As shown, residential structure 310 can be conditioned by residential heating and cooling system 300. Residential heating and cooling system 300 can include an outdoor unit 320 and an indoor unit 330 connected by refrigerant conduit 340. The indoor unit 330 can be positioned in a portion of residential structure 310 such as, for example, a utility room, an attic, a basement, or other suitable location. The refrigerant conduit 340 can transfer refrigerant between the indoor unit 330 and the outdoor unit 320, typically transferring primarily liquid refrigerant in one direction and primarily vaporized refrigerant in an opposite direction.

When the system 300 is operating in an air conditioning mode, one or more heat exchanger 322 in the outdoor unit 320 serves as a condenser for re-condensing vaporized refrigerant flowing from the indoor unit 330 to the outdoor unit 320 via one of the refrigerant conduits 340. In such a mode, one or more heat exchanger 332 of the indoor unit 330 functions as an evaporator. Specifically, the one or more heat exchanger 332 receives liquid refrigerant, which may be expanded by an expansion device, and evaporates the refrigerant before returning it to the outdoor unit 320.

Further, outdoor unit 320 can draw environmental air through the one or more heat exchanger 322 using a fan 324 and can expels the air above the outdoor unit 320. When operating as an air conditioner, the air can be heated by the one or more heat exchanger 322 within the outdoor unit 320 and can exits the unit 320 at a temperature higher than it entered. The indoor unit 330 can include a blower or fan 334 that can direct air through or across the one or more heat exchanger 332 of the indoor unit 330. Further, the air can then be passed through ductwork 350 that can direct the air to the residential structure 310. The overall system 300 can further include a system controller configured to maintain a desired temperature. For example, when the temperature sensed inside the residential structure 310 exceeds a set point the system controller (e.g., thermostat), system 300 can become operative to refrigerate additional air for circulation through the residential structure 310 as previously described.

Additionally, residential heating and cooling system 300 can operate as a heat pump. In such an operating mode, the roles of heat exchangers 322 and 332 are reversed. For example, the one or more heat exchanger 322 of the outdoor unit 320 can serve as an evaporator to evaporate refrigerant and thereby cool air entering the outdoor unit 320 as the air passes over the one or more outdoor heat exchanger 322 and the one or more heat exchanger 332 can receive a stream of air blown over it and heat the air by condensing the refrigerant.

As further depicted, the indoor unit 330 can include a furnace system 360. For example, the indoor unit 330 can include the furnace system 360 when the residential heating and cooling system 300 is not configured to operate as a heat pump. The furnace system 360 can include a burner assembly and heat exchanger, among other components, inside the indoor unit 330. Fuel can be provided to the burner assembly of the furnace 360 where it is mixed with air and combusted to form combustion products. The combustion products can pass through tubes or piping in a heat exchanger such that air directed by the blower 334 passes over the tubes or pipes and extracts heat from the combustion products. The heated air may then be routed from the furnace system 360 to the ductwork 350 for heating the residential structure 310.

Figure 4:
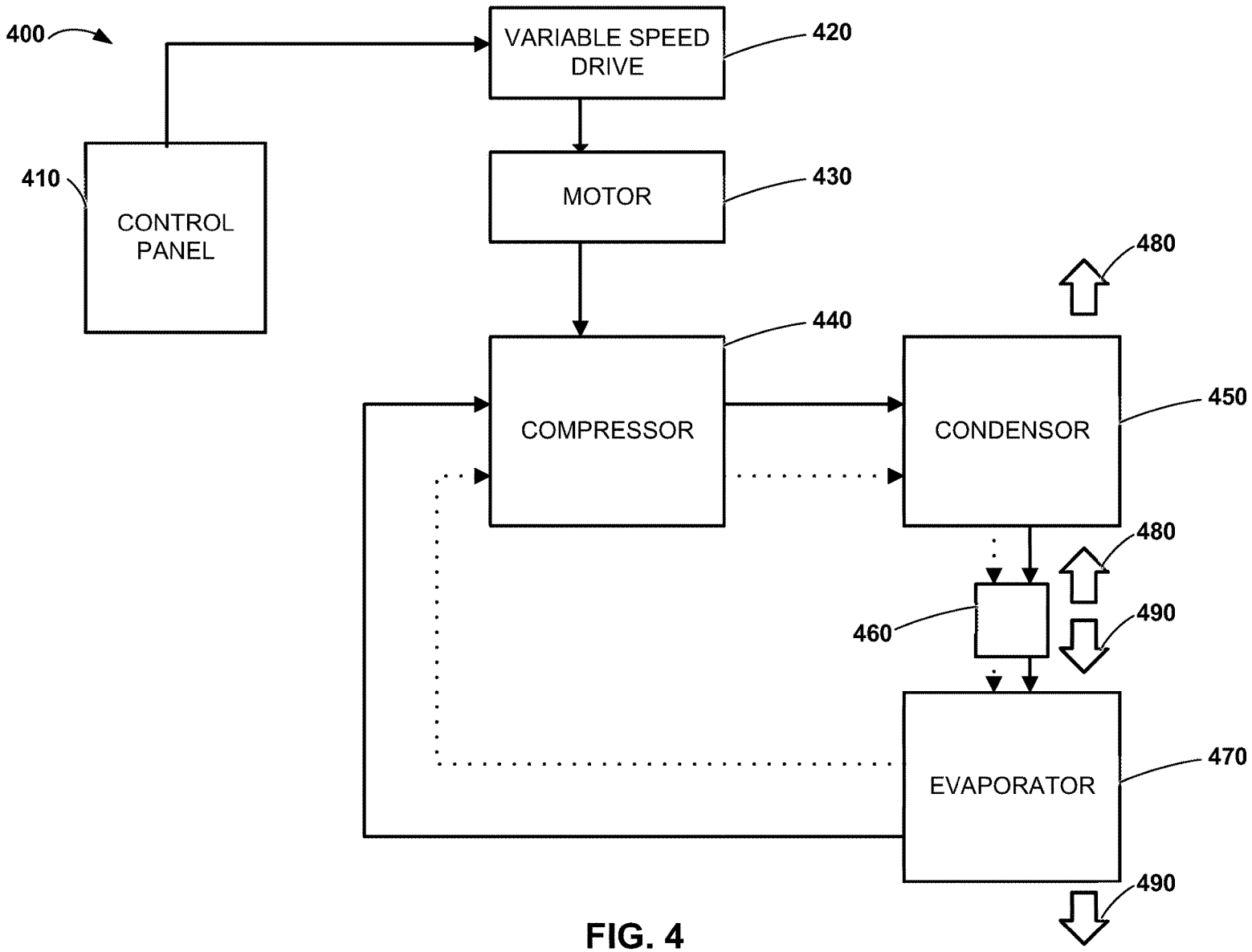
FIG. 4 is a schematic of a vapor compression system for use in systems from FIGS. 1-3, in accordance with some examples of the present disclosure.

FIG. 4 is an embodiment of a vapor compression system 400 that can be used in any of the systems described above. Vapor compression system 400 can circulate a refrigerant through a circuit starting with a compressor 440. The circuit can also include a condenser 450, an expansion valve(s) or device(s) 460, and an evaporator 470. The vapor compression system 400 can further include a control panel 410. Control panel 410 can include various electrical components, such as, for example, an analog to digital (A/D) converter, a microprocessor, a memory, a user interface, or other suitable components. Further, control panel 410 and its components can be configured to regulate operation of the vapor compression system 400 based on feedback from an operator or from environmental sensors associated with vapor compression system 400.

In some embodiments, vapor compression system 400 can use one or more of variable speed drive (VSDs) 420, motor 430, compressor 440, condenser 450, expansion valve or device 460, and/or evaporator 470. As shown, motor 430 can drive the compressor 440 and can be powered by the variable speed drive (VSD) 420. The VSD 420 can receive alternating current (AC) power having a particular fixed line voltage and fixed line frequency from an AC power source, and provide power having a variable voltage and frequency to the motor 430. Motor 430 can be powered directly from an AC or direct current (DC) power source. The motor 430 can include any type of electric motor that can be powered by a VSD or directly from an AC or DC power source, such as a switched reluctance motor, an induction motor, an electronically commutated permanent magnet motor, or another suitable motor.

The compressor 440 can compress one or more refrigerant vapor stream and deliver the one or more vapor stream to the condenser 450 through one or more discharge passage. As depicted, compressor 440 can be a dual-circuit compressor, such as dual-circuit compress 600 depicted in FIG. 6 and described further herein. In other examples, vapor compression system 400 may include one compressor per vapor refrigerant circuit. The refrigerant vapor streams delivered by the compressor 440 to the condenser 450 may transfer heat to a one or more fluid passing across the condenser 450, such as ambient or environmental air 480. The refrigerant vapor streams can condense to respective refrigerant liquids in the condenser 450 as a result of thermal heat transfer with the environmental air 480. The liquid refrigerants from the condenser 450 can then flow through the expansion device 460 to the evaporator 470.

The liquid refrigerant(s) delivered to the evaporator 470 can absorb heat from another air stream, such as a supply air stream 490 provided to the building 10 or the residential structure 310. For example, the supply air stream 490 can include ambient or environmental air, return air from a building, or a combination of the two. The liquid refrigerant(s) in the evaporator 470 can undergo a phase change from the liquid refrigerant to a refrigerant vapor. Further, evaporator 470 can reduce the temperature of the supply air stream 490 through thermal heat transfer with the refrigerant streams. The vapor refrigerant streams can then exit the evaporator 470 and return to the compressor 440 by one or more suction line to complete the cycle.

The condenser 450 and evaporator 470 can include one or more interlaced heat exchanger, such as heat exchanger 500 depicted in FIG. 5 and described further herein. Such interlaced heat exchangers can be configured to share a heat exchange surface area between first coils that are fluidly coupled to a first working fluid circuit and second coils that are fluidly coupled to a second working fluid circuit. As will be appreciated, such interlaced heat exchangers allow for a multiple circuit system having a plurality of refrigerant circuits flowing independently through the system.

As previously discussed, such a design allows for both improvements in heating and cooling performance by allowing for choosing optimal refrigerants. For example, R-744 ($CO_2$), which, in a basic refrigeration cycle, generally performs better in heating (in a heat pump mode) than in cooling (in an air conditioning mode), can be utilized in areas where the heating loads may be higher than the cooling loads. Additionally, such dual-circuit designs allow for the reduction of GWP through the use of smaller amounts of low GWP refrigerants in each respective circuit, which allows for better management of the potential hazards (e.g., flammability, leaks) associated with such refrigerants.

Vapor compression system 400 can include two refrigerant circuits each having the same refrigerant. Specifically, vapor compression system 400 can include two refrigerant circuits each having R-454B, R-32, or other similar refrigerants. As will be appreciated, in such an example, the system 400 can include more refrigerant, thus allowing for more efficient operation, while reducing the charge of each circuit. Alternatively, vapor compression system 400 can include two refrigerant circuits each having a different refrigerant. Specifically, vapor compression system 400 can include two refrigerant circuits with one circuit having R-410A, R-32, R-454B, R-1234yf, or other similar refrigerants and the other circuit having R-290, R-744 ($CO_2$), R1234yf, or other similar refrigerants. As will be appreciated, by minimizing the refrigerant charge in each refrigerant circuit, the systems will be posited to satisfy existing and future safety requirements set forth my standards bodies and/or regulatory bodies (e.g., GWP rating), which can thereby reduce environmental impact.

While the present discussion focuses on an interlaced heat exchanger in a dual circuit system (e.g., dual-circuit HVAC&R system 100, vapor compression system 400, etc.), or a system having a first working fluid circuit and a second working fluid circuit, the present disclosure can also be utilized for systems that include three circuits, four circuits, five circuits, six circuits, seven circuits, eight circuits, nine circuits, ten circuits, or more than ten circuits.

It should be appreciated that any of the features described herein can be incorporated with the HVAC&R unit 20, the residential heating and cooling system 300, or other HVAC systems. Additionally, while the features disclosed herein are described in the context of embodiments that directly heat and cool a supply air stream provided to a building or other load, embodiments of the present disclosure can be applicable to other HVAC systems as well. For example, the features described herein can be applied to mechanical cooling systems, free cooling systems, chiller systems, or other heat pump or refrigeration applications.

FIG. 5 is a perspective view of an embodiment of an interlaced heat exchanger 500 that can be configured to increase an efficiency of a multiple working fluid circuit system. As shown in the illustrated embodiment of FIG. 5, the interlaced heat exchanger 500 can includes a first set of microchannel coils 502 and a second set of microchannel coils 504. The first set of microchannel coils 502 can be fluidly coupled to a first working fluid circulation loop, and the second set of microchannel coils 504 can be fluidly coupled to a second working fluid circulation loop, where the first and second working fluid circulation loops are fluidly separate from one another. The first set of microchannel coils 502 and the second set of microchannel coils 504 can be positioned in an alternating arrangement along a length 506, or height, of the interlaced heat exchanger 500. As further depicted, a first microchannel coil 508 of the first set of microchannel coils 502 can be positioned adjacent to a second microchannel coil 510 and a third microchannel coil 512 of the second set of microchannel coils 504. The remaining microchannel coils of the first set of microchannel coils 502 and the second set of microchannel coils 504 of the interlaced heat exchanger 500 can be arranged in a similar alternating manner. Although the depicted interlaced heat exchanger 500 includes microchannel coils, it is understood that other suitable coils could instead be used, such as, for example tube and fin coils, round tube plate coils, and other similar coils.

As further depicted, a plurality of fins 514 can be disposed between adjacent coils of the first set of microchannel coils 502 and the second set of microchannel coils 504. Accordingly, a fin of the plurality of fins 514 can be coupled to both a microchannel coil of the first set of microchannel coils 502 and a microchannel coil of the second set of microchannel coils 504. Regardless of whether working fluid is circulating through one set of the first set of microchannel coils 502 and the second set of microchannel coils 504, the plurality of fins 514 will facilitate thermal energy transfer between working fluid flowing through the first set of microchannel coils 502 or the second set of microchannel coils 504. In other words, an airflow flowing across the first set of microchannel coils 502 and the second set of microchannel coils 504 exchanges thermal energy with the plurality of fins 514 even when working fluid circulates through only the first set of microchannel coils 502 or only through the second set of microchannel coils 504. As such, an efficiency of the multiple circuit system is increased.

As depicted, the first set of microchannel coils 502 can be fluidly coupled to a first working fluid circulation loop, and the second set of microchannel coils 504 can be coupled to a second working fluid circulation loop, where the first working fluid circulation loop and the second working fluid circulation loop are fluidly separate. As shown in the illustrated embodiment of FIG. 5, the first set of microchannel coils 502 can be fluidly coupled to a first header 518 and a second header 520, where the first header 518 can be positioned on a first end 522 of the interlaced heat exchanger 500, and the second header 520 can be positioned on a second end 524 of the interlaced heat exchanger 500, opposite the first end 522.

Further, the first header 518 can receive working fluid from a component of the first working fluid circulation loop and direct the working fluid into the first set of microchannel coils 502. The second header 520 can receives the working fluid from the first set of microchannel coils 502 and direct the working fluid back toward the component of the first working fluid circulation loop or another component of the first working fluid circulation loop. Similarly, the second set of microchannel coils 504 can be fluidly coupled to a third header 526 and a fourth header 528, where the third header 526 can be positioned on the first end 522 of the interlaced heat exchanger 500, and the fourth header 528 can be positioned on the second end 524 of the interlaced heat exchanger 500. As such, the third header 526 can receive working fluid from a component of the second working fluid circulation loop and direct the working fluid into the second set of microchannel coils 504. The fourth header 528 can receive the working fluid from the second set of microchannel coils 504 and direct the working fluid back toward the component of the second working fluid circulation loop or another component of the second working fluid circulation loop. As will be appreciated such a design results in two distinct fluid circuits within the heat exchanger 500. Though depicted as a two-circuit heat exchanger 500, it will be appreciated that other amounts of circuits can be similarly made, such as for example, 3, 4, 5, or 6 circuit heat exchangers having more fluid circuit paths as a result of including coils.

Figure 6:
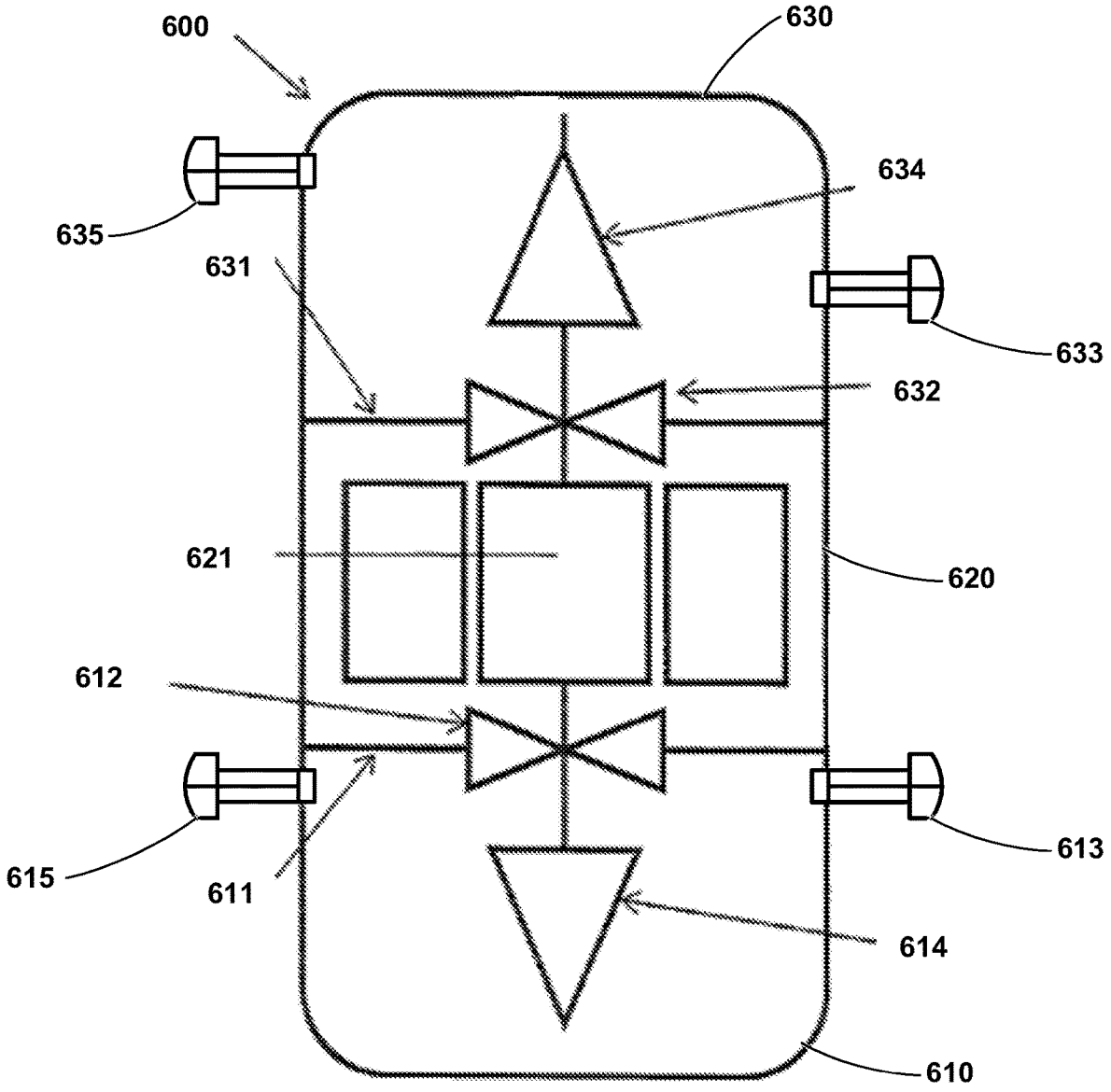
FIG. 6 is a schematic of a dual-circuit compressor for use in systems from FIGS. 1-5, in accordance with some examples of the present disclosure.

FIG. 6 is a schematic of a dual-circuit compressor 600 for use in systems from FIGS. 1-5, in accordance with the present disclosure. As depicted, dual-circuit compressor 600 can include a first compression chamber 610, a motor chamber 620, and a second compression chamber 630. Further, second compression chamber 630 can include and input pipe 633, an output pipe 635, and a compression device 634 and can be sealed off from motor chamber 620 via a partition 631 and seal 632. Additionally, motor chamber 620 can include a motor 621 and can be sealed off from second compression chamber 630 via partition 631 and seal 632 and from first compression chamber 620 via partition 611 and seal 612. First compression chamber 610 can include and input pipe 613, an output pipe 615, and a compression device 614 and can be sealed off from motor chamber 620 via a partition 611 and seal 612. Alternatively, the positions of the first compression chamber 610 and the second compression chamber 630 can be reversed. Further, the compression method of the compression devices 614, 634 can be of any either a reciprocating type, a rotary type, a scroll type, a linear type, or other types and may be single, two, three, multiple, or variable speed type. The multiple compression chambers can be disposed in any desired arrangement. For example, the compression chambers 610, 630 can be arranged such that one is above the other (i.e., disposed at a height that is greater than the height of the other chamber). As another example, the compression chambers 610, 630 can be arranged such that the compression chambers 610, 630 are at the same height (e.g., disposed on either side of the motor chamber 620).

Any component described in one or more figures herein can apply to any other figures having the same label. In other words, the description for any component of a figure can be considered substantially the same as the corresponding component described with respect to another figure. For any figure shown and described herein, one or more of the components may be omitted, added, repeated, and/or substituted. Accordingly, embodiments shown in a particular figure should not be considered limited to the specific arrangements of components shown in such figure.

In this description, numerous specific details have been set forth. It is to be understood, however, that implementations of the disclosed technology may be practiced without these specific details. In other instances, well-known methods, structures and techniques have not been shown in detail in order not to obscure an understanding of this description. References to "one embodiment," "an embodiment," "some embodiments," "example embodiment," "various embodiments," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic. Further, repeated use of the phrase "in one implementation" does not necessarily refer to the same implementation, although it may.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified and are not meant to limit embodiments of water heating devices or heat exchangers. In the foregoing detailed description of the example embodiments, numerous specific details are set forth in order to provide a more thorough understanding of the disclosure. However, it will be apparent to one of ordinary skill in the art that the example embodiments may be practiced without these specific details. In other instances, well-known features have not been described in detail to avoid unnecessarily complicating the description.

Accordingly, many modifications and other embodiments set forth herein will come to mind to one skilled in the art to which example water heaters pertain having the benefit of the teachings presented in the foregoing descriptions and the associated drawings. Therefore, it is to be understood that example water heaters are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A heating, ventilation, and air conditioning (HVAC) system comprising:

a compressor comprising:
- a first compression chamber,
- a second compression chamber, and
- a motor;

a heat exchanger comprising:
- a first set of microchannel coils, and
- a second set of microchannel coils;

an evaporator;

a condenser comprising a third set of microchannel coils and a fourth set of microchannel coils:

a first refrigerant circuit fluidly coupled to the first compression chamber, the first set of microchannel coils, and the third set of microchannel coils; and a second refrigerant circuit fluidly coupled to the second compression chamber, the second set of microchannel coils, and the fourth set of microchannel coils, the second circuit being fluidly separated from the first circuit.

2. The HVAC system of claim 1, wherein the first refrigerant circuit comprises a first refrigerant and the second refrigerant circuit comprises a second refrigerant.

3. The HVAC system of claim 2, wherein the first refrigerant and the second refrigerant comprise the same type of refrigerant.

4. The HVAC system of claim 3, wherein the first refrigerant and the second refrigerant comprise R-454B.

5. The HVAC system of claim 3, wherein the first refrigerant and the second refrigerant comprise R-32.

6. The HVAC system of claim 2, wherein the first refrigerant and the second refrigerant comprise different types of refrigerant.

7. The HVAC system of claim 6, wherein the first refrigerant comprises one of R-32 and R-454B and the second refrigerant comprise one of R-290, R-744 (CO2), and R-454B.

8. The HVAC system of claim 1, wherein the evaporator comprises:

an evaporator heat exchanger comprising:
- a fifth set of microchannel coils, and
- a sixth set of microchannel coils, wherein the first refrigerant circuit is fluidly coupled with the fifth set of microchannel coils and the second refrigerant circuit is fluidly coupled with the sixth set of microchannel coils.

9. An environmental control system comprising:

an indoor unit comprising:
- a compressor comprising:
  - a first compression chamber,
  - a second compression chamber, and
  - a first motor;
- a heat exchanger comprising:
  - a first set of microchannel coils, and
  - a second set of microchannel coils;

a first refrigerant conduit;

a second refrigerant conduit;

an outdoor unit comprising:
- a compressor comprising:
  - a third compression chamber,
  - a fourth compression chamber, and
  - a second motor;
- a heat exchanger comprising:
  - a third set of microchannel coils, and
  - a fourth set of microchannel coils;

a first refrigerant circuit comprising the first compression chamber, the first set of microchannel coils, the first refrigerant conduit, the third compression chamber, and the third set of microchannel coils; and a second refrigerant circuit fluidly comprising the second compression chamber, the second set of microchannel coils, the second refrigerant conduit, the fourth compression chamber, and the fourth set of microchannel coils, the second refrigerant circuit being fluidly separate from the first refrigerant circuit.

10. The environmental control system of claim 9, wherein the first refrigerant circuit comprises a first refrigerant and the second refrigerant circuit comprises a second refrigerant.

11. The environmental control system of claim 10, wherein the first refrigerant and the second refrigerant comprise the same type of refrigerant.

12. The environmental control system of claim 11, wherein the first refrigerant and the second refrigerant comprise R-454B.

13. The environmental control system of claim 11, wherein the first refrigerant and the second refrigerant comprise R-32.

14. The environmental control system of claim 10, wherein the first refrigerant and the second refrigerant comprise different types of refrigerant.

15. The environmental control system of claim 14, wherein the first refrigerant comprises one of R-32 and R-454B and the second refrigerant comprise one of R-290, R-744 (CO2), and R-454B.

16. A vapor compression system comprising:

a compressor comprising:
- a first compression chamber having an input pipe and an output pipe,
- a second compression chamber having an input pipe and an output pipe, and
- a motor;

a condenser comprising:
- a first heat exchanger comprising:
  - a first set of microchannel coils, and
  - a second set of microchannel coils;

an evaporator comprising:
- a second heat exchanger comprising:
  - a third set of microchannel coils, and
  - a fourth set of microchannel coils;

a first refrigerant circuit comprising the first compression chamber, the first set of microchannel coils, and the third set of microchannel coils; and a second refrigerant circuit comprising the second compression chamber, the second set of microchannel coils, and the fourth set of microchannel coils, the second refrigerant circuit being fluidly separate from the first refrigerant circuit.

17. The vapor compression system of claim 16, wherein the first refrigerant circuit comprises a first refrigerant and the second refrigerant circuit comprises a second refrigerant.

18. The vapor compression system of claim 17, wherein the first refrigerant comprises one of R-32 and R-454B and the second refrigerant comprise one of R-290, R-744 (CO2), and R-454B.

* * * * *